United States Patent [19]

Wagner et al.

[11] Patent Number: 4,565,315

[45] Date of Patent: Jan. 21, 1986

[54] FOLDING BOX HAVING INSIDE LINING AND ALSO METHOD AND APPARATUS FOR THE PRODUCTION THEREOF

[75] Inventors: Heinz Wagner, Contwig; Karl Schieler, Waldfischbach-Burgalben, both of Fed. Rep. of Germany

[73] Assignee: CP Schmidt-Verpackungswerk GmbH & Co., KG, Kaiserslautern, Fed. Rep. of Germany

[21] Appl. No.: 622,850

[22] Filed: Jun. 21, 1984

[51] Int. Cl.[4] ..... B65D 17/00

[52] U.S. Cl. ..... 229/17 R; 220/416; 220/460

[58] Field of Search ..... 229/17 R; 220/416, 449, 220/460

[56] References Cited

U.S. PATENT DOCUMENTS

| | | | |
|---|---|---|---|
| 788,381 | 4/1905 | Smith | 229/17 R |
| 3,113,712 | 12/1963 | Kindseth | 229/17 R |
| 3,367,553 | 2/1968 | Francis | 229/17 R |
| 3,426,955 | 2/1969 | Olson | 229/17 R |
| 3,550,833 | 12/1970 | Rahenkamp | 229/17 R |
| 3,580,466 | 5/1971 | Thelen et al. | 229/17 R |

FOREIGN PATENT DOCUMENTS 3129496 11/1983 Fed. Rep. of Germany .

*Primary Examiner*—Joseph Man-Fu Moy

*Attorney, Agent, or Firm*—Fitzpatrick, Cella, Harper & Scinto

[57] ABSTRACT

The inside lining of a folding box having inside lining (9), an opening area for extraction (100) in the box cut-out (10) and a window opening area (106), which area is connected with the latter, in the inside lining is to be constructed in the form of a tube, that is, in such a way that it is closed in the longitudinal direction of the tube. In order to make this possible, a prefabricated foil tube, which lies flat, is to be provided with impressions for the window opening areas. In order that only the one side of the foil tube which has been laid flat is impressed, the foil tube is passed in a punching apparatus between an impressing cylinder and a countercylinder, between which a space is preserved by means of spacer rings. The space substantially corresponds to the thickness of the double-layer foil tube which lies flat. A punch cutting section, which is provided on the impressing cylinder, is to rise above the surface of the impressing cylinder only substantially up to a height which is equal to half of the width of the gap between the impressing cylinder and the countercylinder.

5 Claims, 12 Drawing Figures

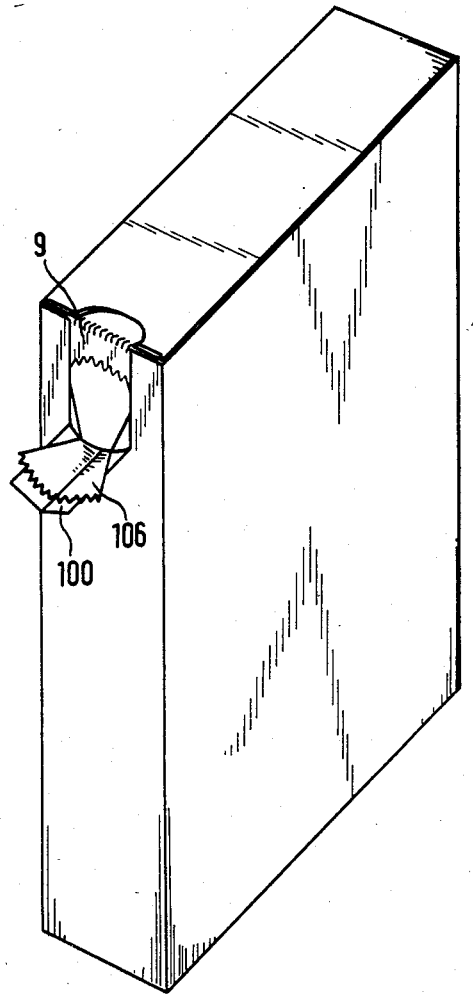
FIG. 5
FIG. 12
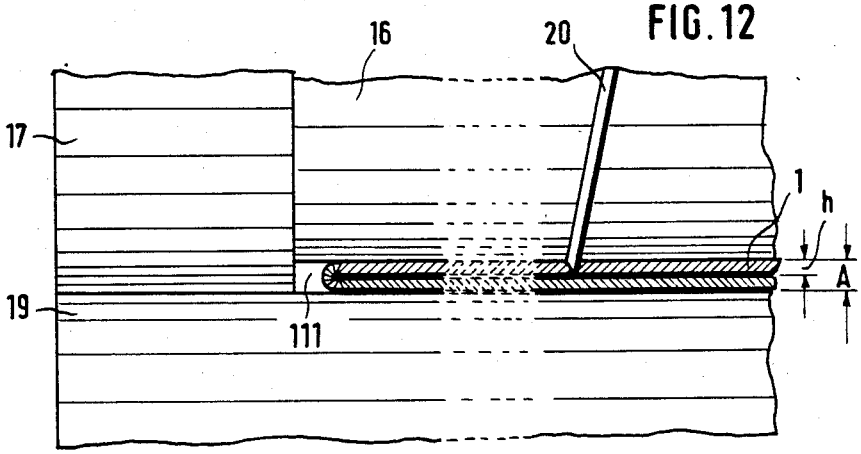

FOLDING BOX HAVING INSIDE LINING AND ALSO METHOD AND APPARATUS FOR THE PRODUCTION THEREOF

BACKGROUND OF THE INVENTION

1. Field of the Invention

The invention relates to a folding box having inside lining, in which case the box cutout has a prepunched opening area for extraction, which area may be ripped open, and the inside lining has a corresponding impressed window opening area and in which case at least the box cutout's opening area for extraction and the window opening area of the inside lining are connected with each other through glueing, welding, heat-sealing or the like.

2. Description of the Prior Art

Folding boxes of the kind described above are governed by two demands making claims in opposite directions. On the one hand, the boxes should be as impervious as possible (in which case distinction is made between various degrees of imperviousness, such as trickleproof, dustproof, greaseproof, steamproof, aromaproof, liquidtight and vacuum tight); on the other hand, they should guarantee easy opening, controlled emptying of the product contained therein and also, as far as possible, reclosing. In order to meet the last-named demand, they are provided with a prepunched opening area for extraction, which area may be ripped open, in the box cutout and with a corresponding impressed window opening area in the inside lining. The impressions of the inside lining can, however, in their turn, result in leakages. Cardboard is, as a rule, used for the box cutout. The material of the inside lining determines the imperviousness. A paper foil, plastic foil, metal foil, plastic-coated paper foil, plastic-coated metal foil or the like can be used for this.

It is obvious that special significance is attached to the impressing of the window opening areas on the inside lining foil when producing the folding boxes in order to meet the demand for imperviousness. "Impressing", to all practical purposes, means a slight slitting of the inside lining foil without piercing it. As a result of the impressing, the window opening area should come loose from the rest of the inside lining in a defined shape when the opening area for extraction, which is provided on the box cutout and with which the said window opening area is preferably connected through glueing, is ripped open and should remain stuck on the opening area for extraction. The impressing of the window opening areas on the inside lining foil is therefore carried out in a separate operation before the inside lining is united with the box cutouts. This is described, by way of example, in Patent No. 31 29 496 belonging to the Applicant.

Previously, considerations were based on the fact that only one single-layer inside lining foil can be impressed in such a way that it meets the demands described above. After the inside lining foil had been united with a box cutout, the latter was then erected, folded and glued. Care was thereby taken to see that two border areas of the single-layer inside lining foil came to lie side by side or one upon the other in such a way that a tubular form emerged for the inside lining and this was in order to coat the interior space of the folding box completely with internal lining. Previously, the border areas of the internal lining lying together were not connected in the case of the folding boxes considered here, that is, in the case of such boxes having opening area for extraction and window opening area, so that a weak point for the imperviousness of the folding boxes, which was striven for, emerged.

The underlying object of the invention is to improve folding boxes of the kind described by way of introduction to the effect that the level of imperviousness is increased.

SUMMARY OF THE INVENTION

The object is achieved according to the invention as the inside lining is formed by a foil tube piece which is closed in the longitudinal direction of the tube.

The reason why folding boxes of the kind considered here, that is, such boxes having opening area for extraction in the box cutout and window opening area in the inside lining, have previously not been produced with a laterally closed foil tube piece, is clearly that difficulties, which could not be overcome, arose when connecting the border areas, which lie together, of the inside lining foil in the folded and erected box cutout on accout of insufficient accessibility. Even the use of a prefabricated foil tube closed in the longitudinal direction was not taken into consideration, because it was always assumed that the inside lining, which is to be impressed immediately before the union with the folding cutouts, must be impressed in one layer. It has now become apparent that, as will be explained further later, it is also possible to impress a prefabricated foil tube, which is closed in the longitudinal direction, when it is laid flat, that is, when it is in double-layer form, without causing the imperviousness to suffer or without jeopardizing the defined opening of the window area, which has been impressed. Only once this was recognized, was it possible to consider the solution for achieving the object set, as specified above.

In order to counteract leakages, which still arise unintentionally at the impressed window opening area of the inside lining, there may be provided according to one development of the invention, in addition to the connection between the window opening area and the opening for extraction, a further connection which partially or completely frames the window opening area. This connection can be made by means of a corresponding pattern of glue which is applied upon the box cutout before the box cutout and the inside lining are connected.

In order to counteract damage, which is also unintentional, to that foil wall area of the foil tube piece which has been laid flat and which lies on the side remote from the tool for impressing, it is proposed, furthermore, that between the foil tube piece and the box cutout there be provided a further connection which is specularly symmetrical to the connection between the window opening area and the opening area for extraction with regard to a folding line, which develops on the foil tube piece when the latter is laid flat, and which partially or completely frames that area which corresponds to the window opening area.

The folding line of the foil tube piece, which line forms the symmetric line, will as a rule extend next to a folding line of the box cutout, which line forms an edge of the folding box.

If the foil tube piece is plastic-coated on the inside, the tube form may, for example, be produced by heat-sealing two parallel border areas of a single-layer course of foil, which areas are laid together. In this case, the folding line of the foil tube piece, which line forms the ymmetric line mentioned above, and the heat-sealed order areas extend parallel to each other.

BRIEF DESCRIPTION OF THE DRAWINGS

Exemplary embodiments of the invention are described in the following with the aid of the drawings.

FIG. 5 shows the finished folding box having opening rea for extraction, which has been ripped open, and vindow opening area of the inside lining which sticks nereto;

FIG. 12 shows a cutaway portion from FIG. 10 nowing a portion of the impressing cylinder with pacer ring and also the countercylinder and the punch utting section.

DETAILED DESCRIPTION OF THE PREFERRED EMBODIMENT

Figure 1:
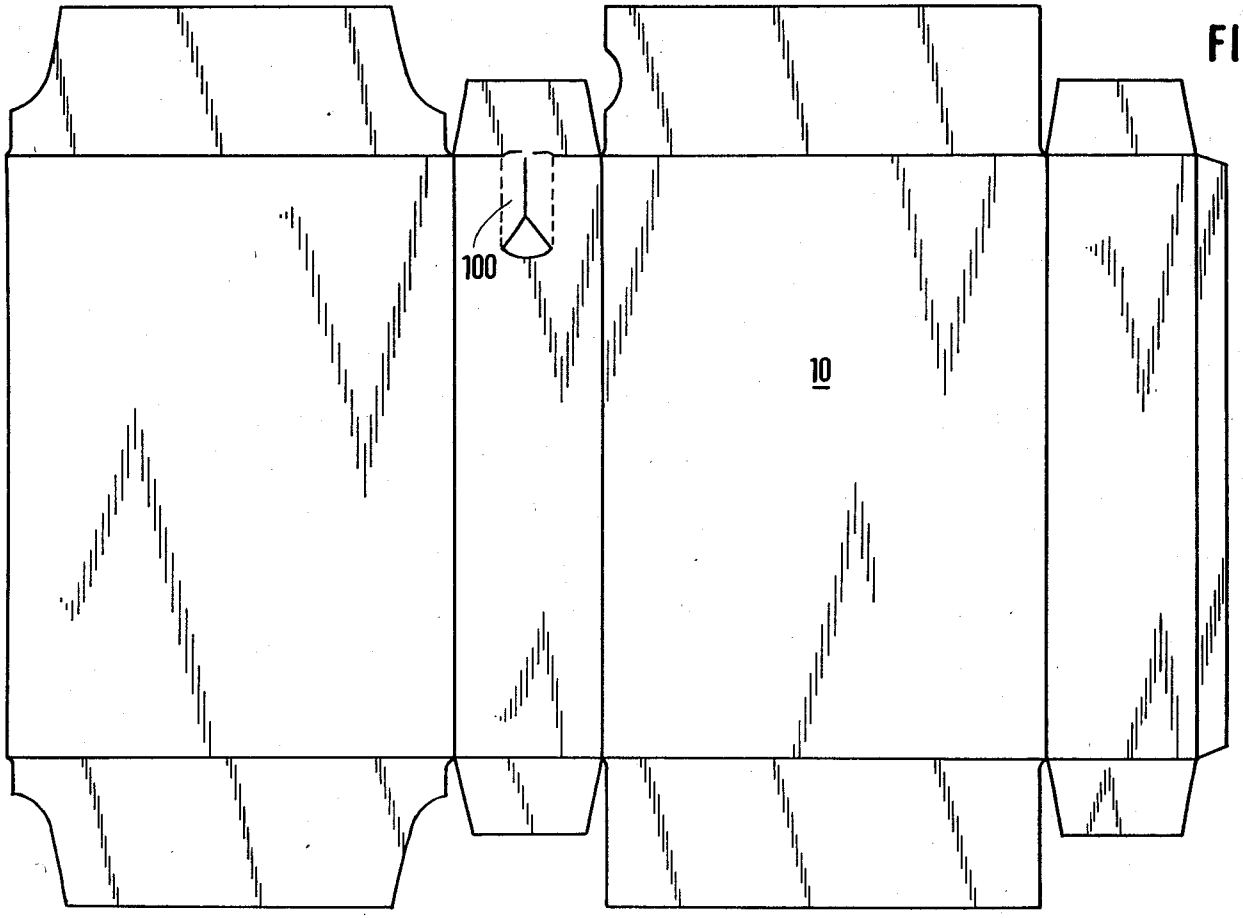
FIG. 1 shows a box cutout of the folding box; without oating of glue.

The box cutout 10, which is shown in FIG. 1, is proided with a prepunched opening area for extraction 00 which area is similar to that described in the prior ierman Patent Application No. P 33 01 999.1 belongig to the Applicant. The broken lines of the opening rea for extraction 100 indicate a perforation, while the ontinuous lines are folding lines.

Figure 2:
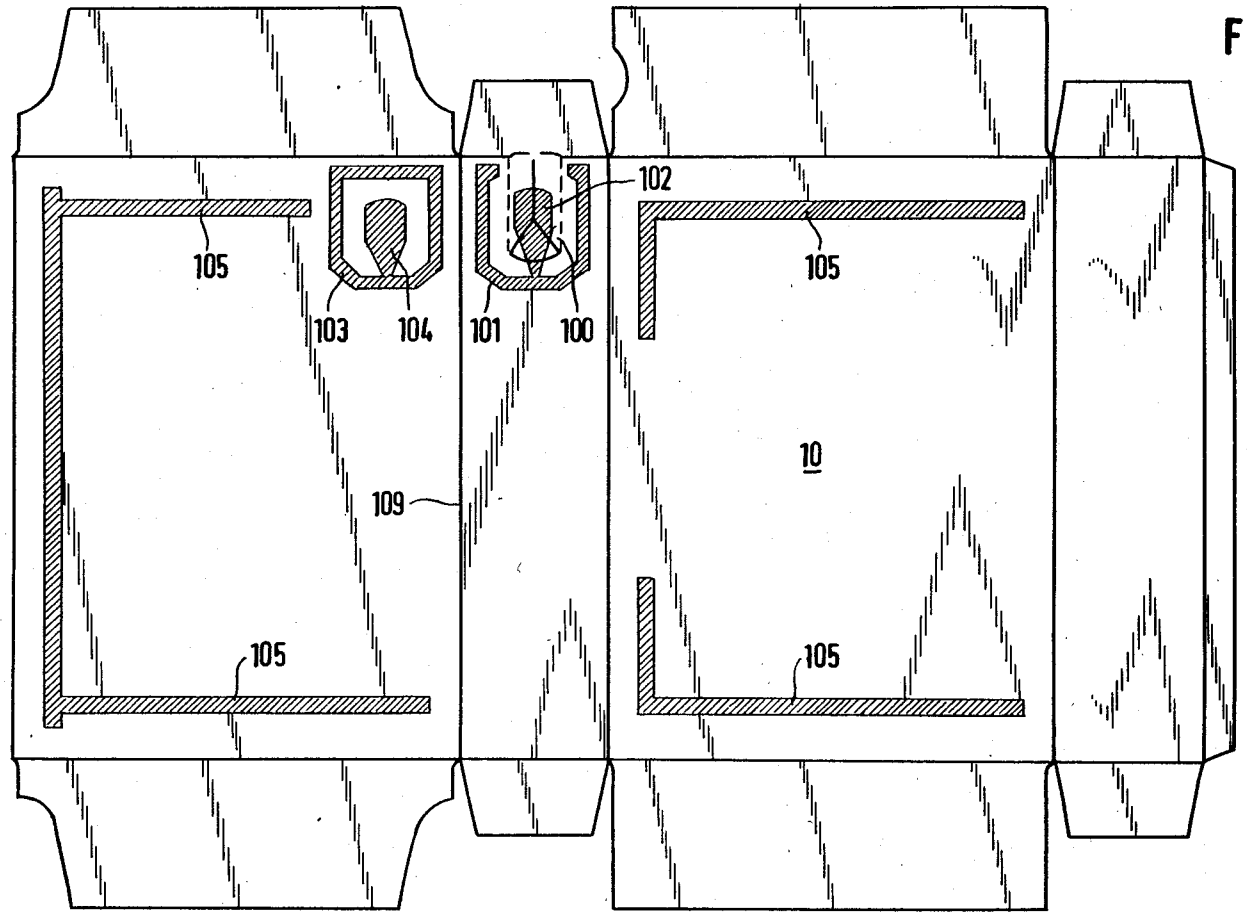
FIG. 2 shows the box cutout shown in FIG. 1; now vith coating of glue.

In the course of the production process, the box cutut 10, which is shown in FIG. 1, is provided with atterns of glue. As shown in FIG. 2, girders of glue 05, which serve to connect the side walls of the box utout 10 and the foil tube piece, which is still to be escribed, form part of these glue patterns. Furtherore, there is provided inside the opening area for xtraction 100 a glue pattern 102 which serves to conect the opening area for extraction 100 and the winow opening area of the foil tube piece, which area is ill to be described. Furthermore, there is provided a ame of glue 101, which is not complete and which irrounds the opening area 100 for extraction. In addion to the glue patterns 101 and 102, there are proided, furthermore, at a folding line 109 of the box utout 10 mirrored glue patterns 103 and 104.

Figure 3:
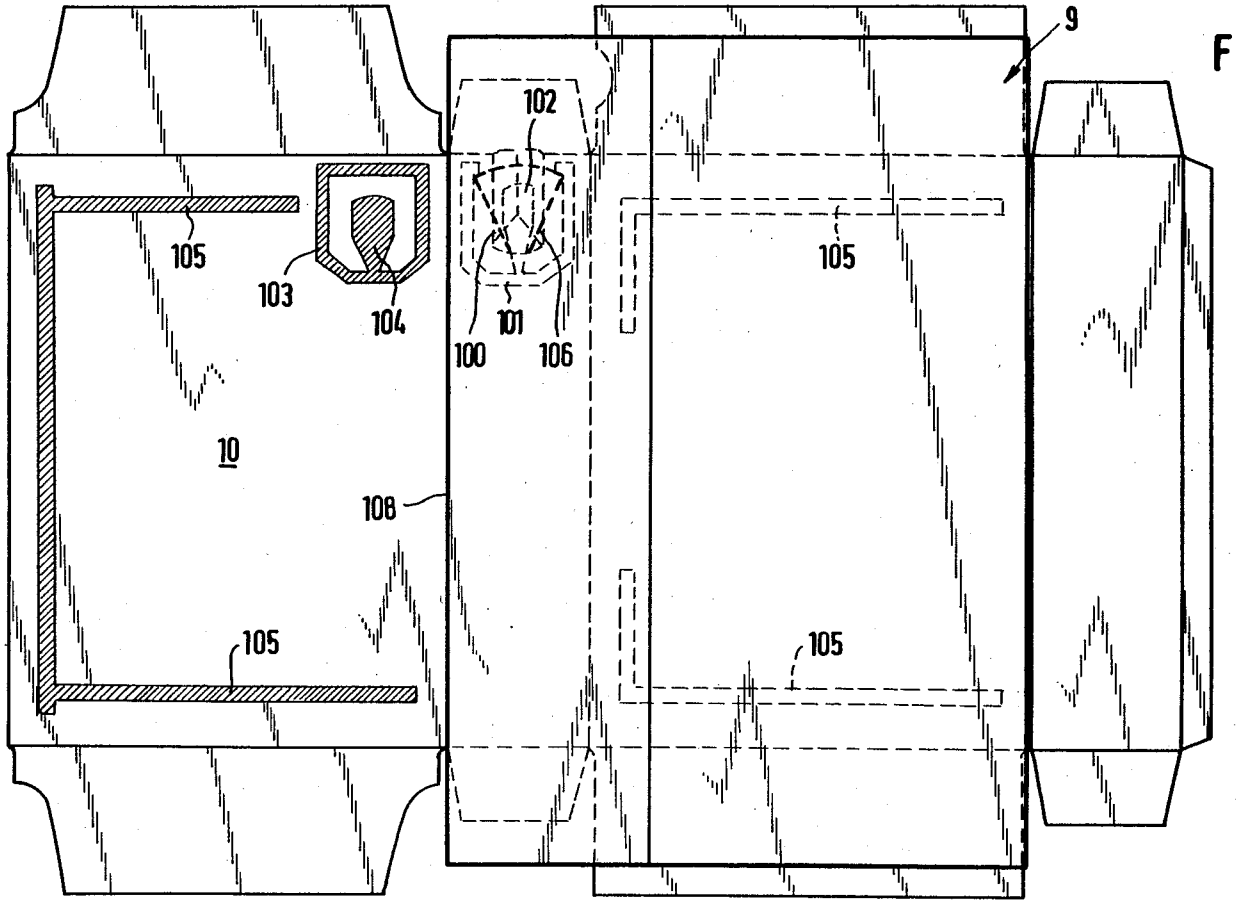
FIG. 3 shows the box cutout, which is shown in FIG. and is provided with a coating of glue, now having a oil tube piece stuck thereon.
Figure 4:
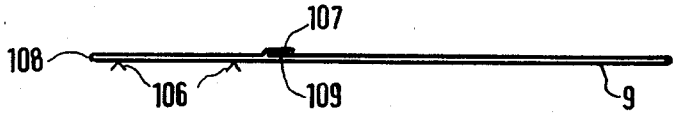
FIG. 4 shows a front view of the foil tube piece vhich has been laid flat.

FIG. 3 shows that a foil tube piece 9, which is folded ogether and which is represented in FIG. 4, is laid pon a portion of the box cutout 10. The underside of ie foil tube piece 9 is provided with an impressed winow opening area 106. The window opening area 106 is onnected with the opening area for extraction 100 by ieans of the glue pattern 102 (see FIG. 2). Two corners f the window opening area 106 project laterally over ie opening area for extraction 100. They are, however, ot glued together with the box cutout 10. That is why these corners come loose easily when the opening area for extraction 100 is ripped open and are taken along by the glued window opening area 106. This can be seen in FIG. 5 which shows the finished, yet opened, folding box. The purpose of the projecting corners of the window opening area 106 is that they hook in behind the edge of the opening and carry out the function of keeping the area shut when the opening area for extraction 100 is closed again.

It is also seen in FIG. 3 that the glue pattern 102 lies inside the window opening area 106 and the opening area for extraction 100 and therewith connects the two. Furthermore, it is seen that the glue pattern 101 for the most part frames the window opening area 106. The frame is solely interrupted at the top, because otherwise that portion of the inside lining which is found there would be ripped along with the opening area for extraction 100 when the latter is opened. The frame-shaped glue pattern 101 represents a guarantee against damage to the impressed foil tube wall and, in the case of a folding box which has been opened and closed again, prevents the product packed in the folding box from being able to trickle or flow in through the opening gap, which has been closed again, along the impressing line of the window opening area 106 between the foil tube 9 and the folding box cardboard.

A perfect seal is guaranteed in the event of damage to the opposite wall side of the foil tube piece 9 through the glue pattern 103 which is developed as a completely closed frame.

It is still to be pointed out that the folding line 108 on the foil tube piece 9 (FIG. 4) comes to lie next to the folding line 109 of the box cutout 10 (FIG. 2) and thus also forms a symmetric line for the two frame-shaped glue patterns 101, 103.

Figure 6:
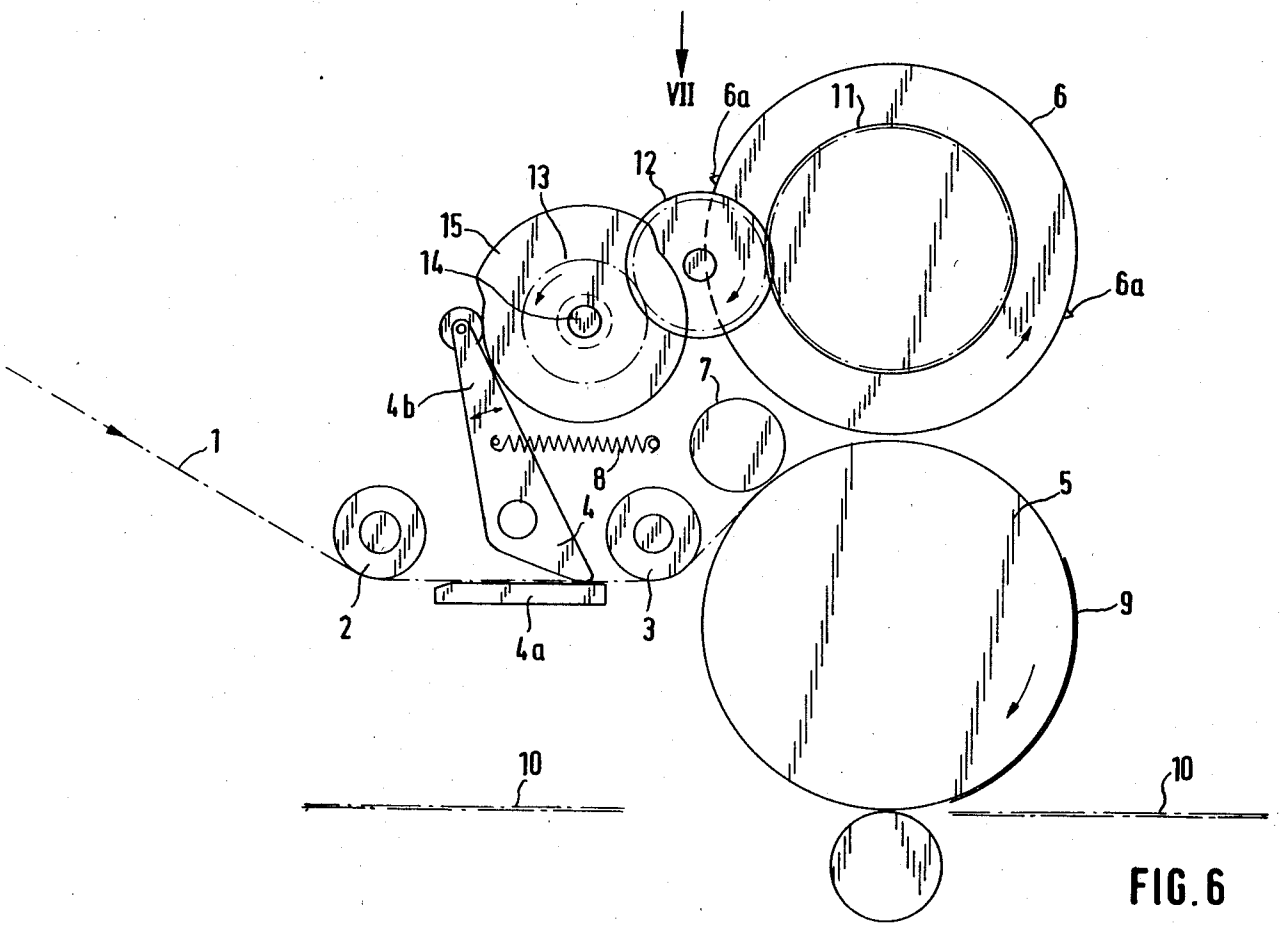
FIG. 6 shows the forward-feed, cutting-off and glueig-in system of the apparatus.

FIG. 6 shows a first portion of an apparatus for carrying out a method for the production of the folding box shown in FIG. 5. This is the forwardfeed, cutting-off and glueing-in system, without punching unit.

A roller conveying apparatus, which is not shown in the drawing, pushes a foil tube 1 made of paper, which is ready-made, but which is laid flat, through by way of a deflection roller 2 between a brake shoe 4 and a counterbearing 4*a* and further by way of a deflection roller 3 onto a vacuum cylinder 5 which is directly connected in terms of drive with a cutter cylinder 6. The driving apparatus of the vacuum cylinder 5 and of the cutter cylinder 6 is not shown in the drawing.

A loose pressure roller 7 is loaded with spring tension and, lying upon the vacuum cylinder 5, guarantees the contact of the tube with the vacuum cylinder 5.

In accordance with the respective advance of the foil tube 1, there follows per rotation of the vacuum cylinder 5 or of the cutter cylinder 6 an advance with a fixed length. The length advanced is equal to the length cut off.

Several cut-off lengths can also be obtained per rotation, if more than two cutters 6*a* are arranged on the cutter cylinder 6.

In order to guarantee uniform cut-off lengths, the brake shoe 4 is pressed against the counterbearing 4*a* by means of spring tension 8 so that a short-time stop of advance of the foil tube results. During the stop, a foil tube piece 9 is cut off, which piece is held fast by the vacuum cylinder 5 and is laid upon and pressed against a box cutout 10 which has already previously been provided with a glue pattern. The transportation of the box cutout 10 is not represented.

Figure 7:
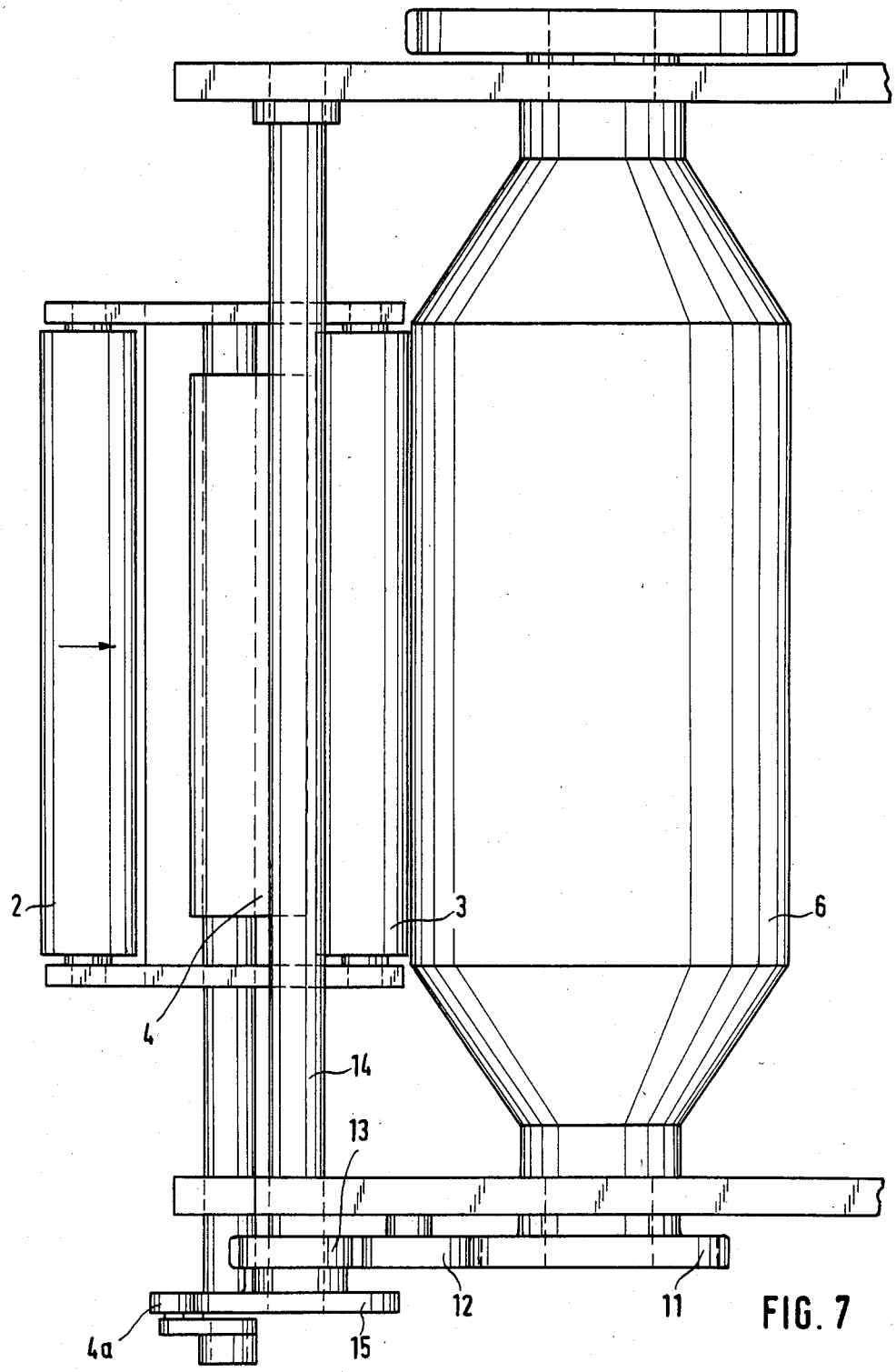
FIG. 7 shows a view VII from FIG. 6.

FIG. 7 shows a plan view of the feed unit and the driving apparatus for the control of the brake shoe.

A gear wheel 11, sitting on the cutter cylinder 6, transmits the torque by way of an intermediate gear wheel 12 and a gear wheel 13 to a shaft 14. A cam 15, which controls the brake shoe 4 by way of a lever 4*b*, sits on the shaft 14. The gear wheels 11 and 13 are change gear wheels and must be changed according to the number of pieces cut off per cylinder rotation.

In order to impress the window opening areas 106, there is required a driven impressing cylinder, which in terms of its periphery must correspond to the foil tube length cut off. A cylinder for impressing 16 having spacer rings 17 (so-called bearer rings) is used. The distance of the spacer rings 17 in respect of each other is greater than the maximum width of the foil tube which lies flat.

A pressure screw device 18 causes the spacer rings 17 to be constantly pressed onto a countercylinder 19, appertaining thereto, whereby the necessary punching pressure for the impressing cylinder 16 is produced.

As may be inferred from FIG. 12, the impressing cylinder 16 is provided with a punch cutting section 20 which projects into the gap 111 formed between the impressing cylinder 16 and the countercylinder 19 up to a height h. This height h is substantially only half as high as the diameter A of the gap 111. The latter is chosen so that it substantially corresponds to the thickness of a foil tube 1 which is laid flat.

The countercylinder is loosely mounted on the existing shaft 14. The shaft 14 operates on account of the gearing of the change gear wheels 11 and 13 with one rotation per foil tube piece 9. The shaft 14 is used, moreover, as a drive for the impressing cylinder 16 (see FIGS. 8 and 9).

Figure 11:
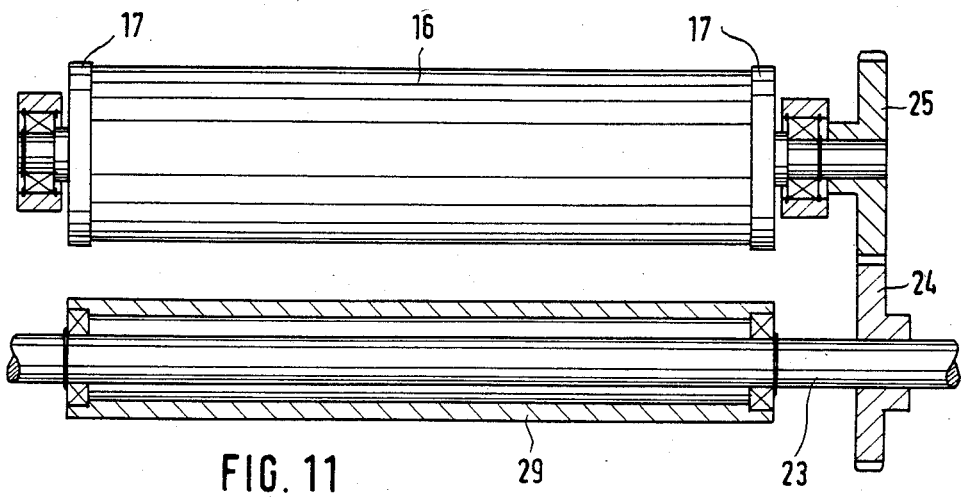
FIG. 11 shows a section XI—XI through FIG. 8.

There is secured on the shaft 14 a gear wheel 21, which by way of a gear wheel 22 causes a shaft 23 to rotate, which rotation results in the drive acting on the impressing cylinder 16 by way of a further gear wheel 24 and a gear wheel 25 (see FIG. 11).

Figure 10:
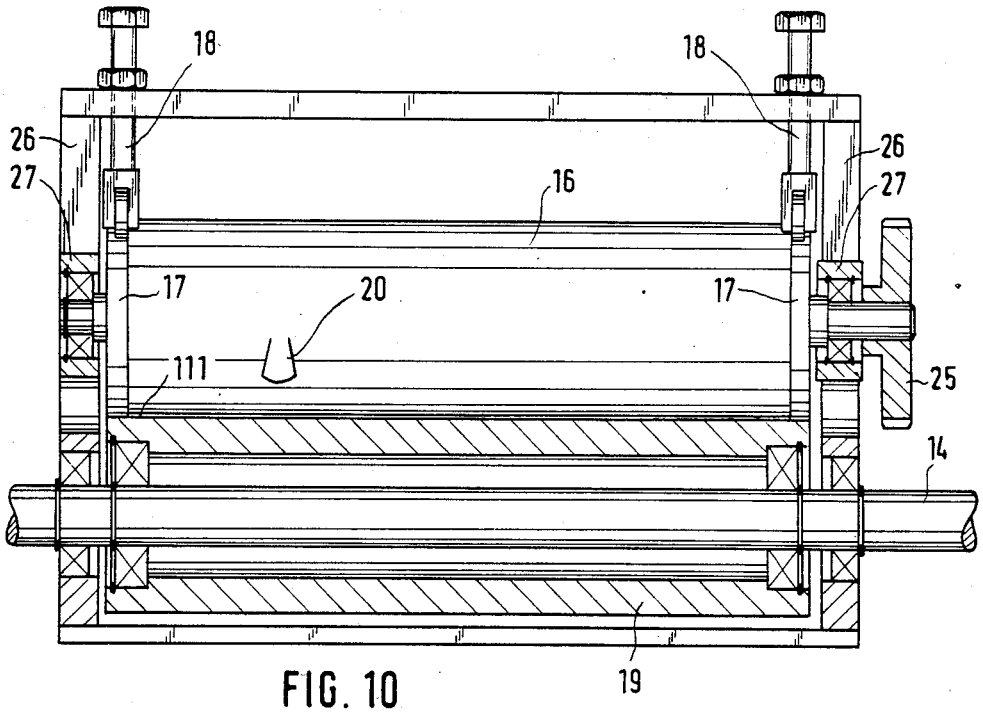
FIG. 10 shows a section X—X through FIG. 8.

At the same time, there is mounted on the shaft 14 another pair of connecting links 26 bearing two link blocks 27 which serve to hold the impressing cylinder 16 (FIG. 10).

The impressing cylinder 16 can be pushed into the two connecting links regardless of its respective diameter and can be fixed with the clamping devices 18.

The pair of connecting links with the impressing cylinder 16 and the gear wheel 25 can then be swung again into the drive of the gear wheel 24 about the shaft 14. A clamping coverplate 28 serves to effect the fixation (see FIGS. 8, 9, 11).

Figure 8:
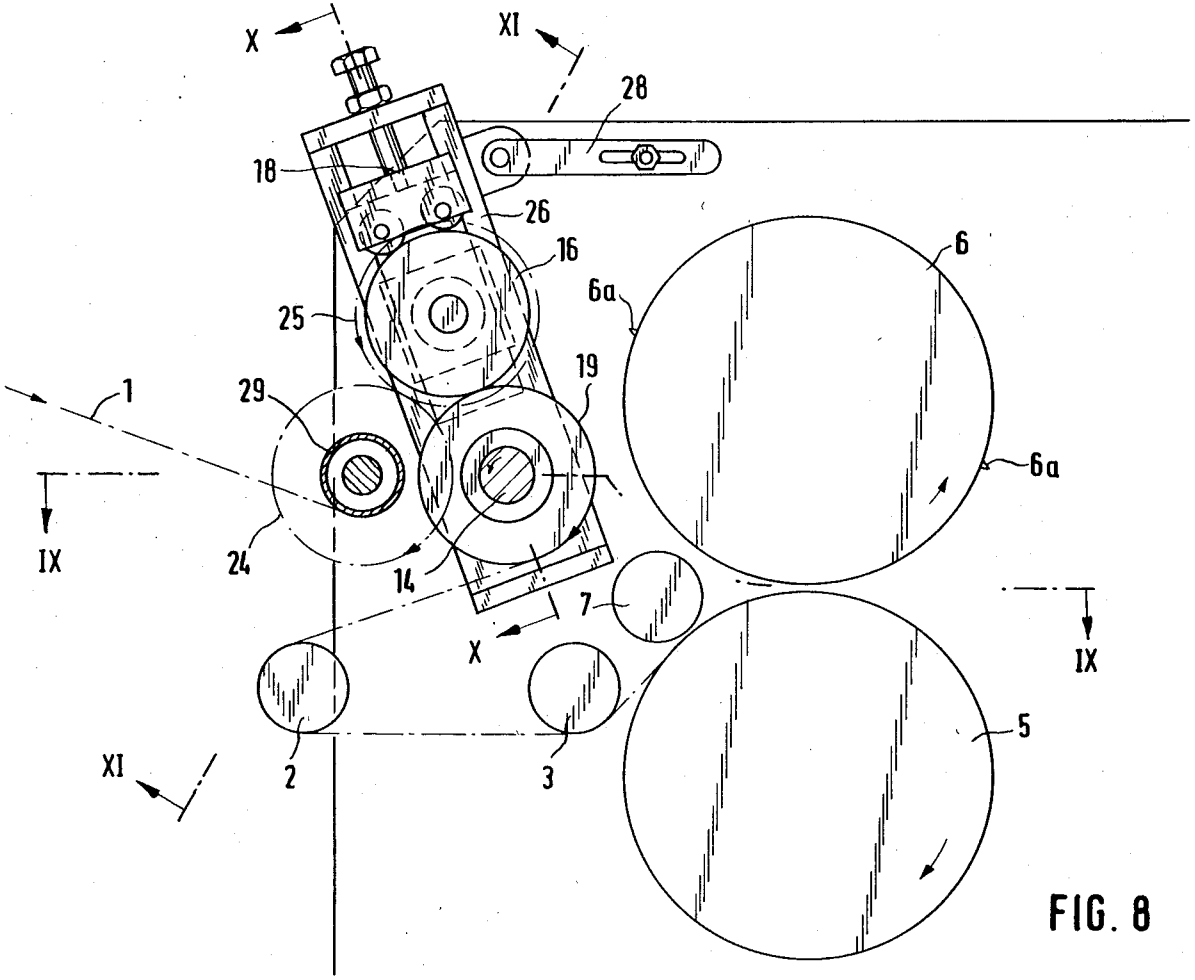
FIG. 8 shows that portion of the apparatus which npresses, working together with some of the portions f the apparatus shown in FIG. 6.
Figure 9:
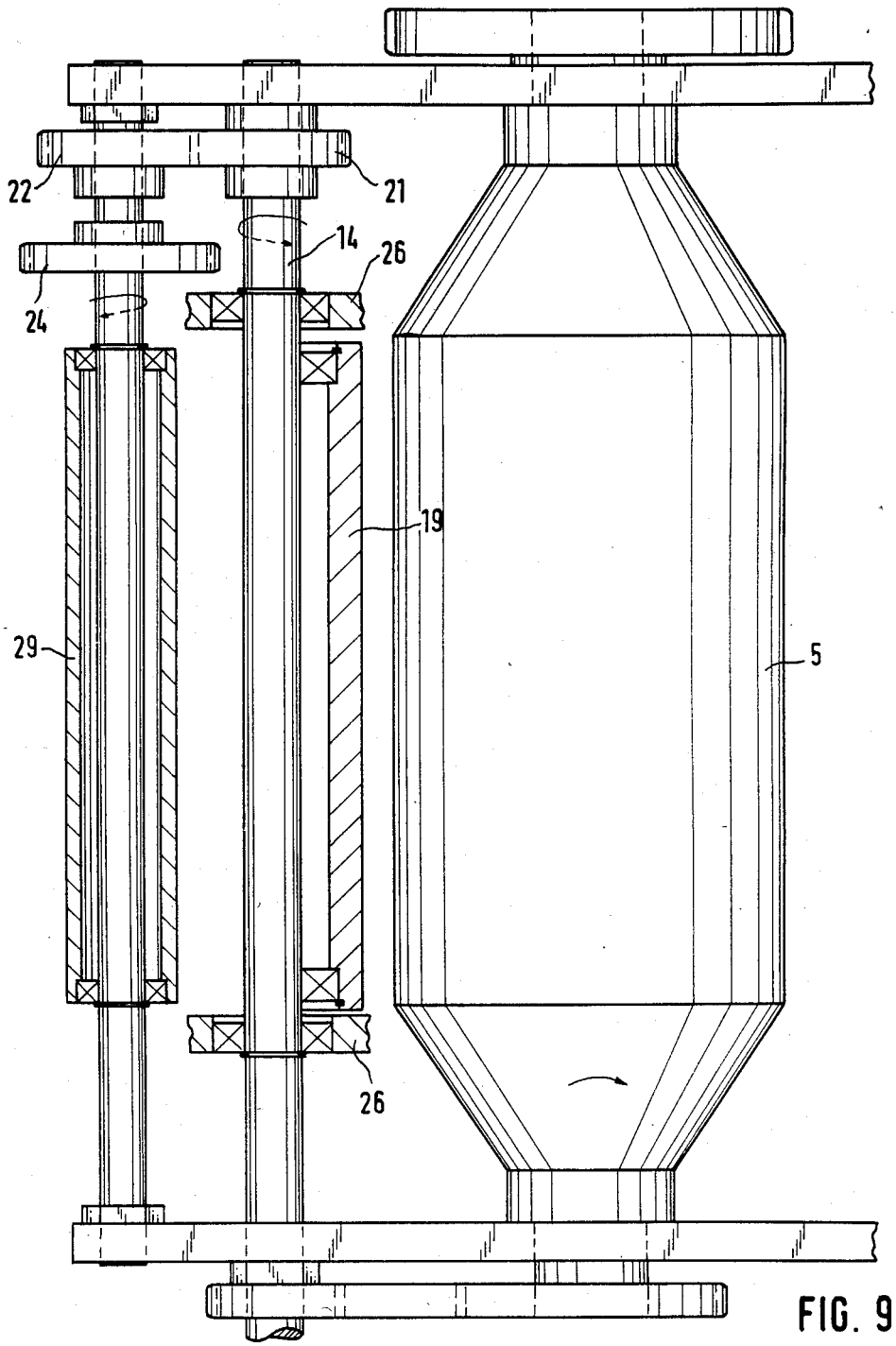
FIG. 9 shows a section IX—IX through FIG. 8.

In FIG. 8, it is shown how the foil tube 1 must run through the punching device. It runs, pushed by a conveyor roller, which is not shown in the drawing, by way of a deflection roller 29 between the spacer rings 17 of the impressing cylinder 16 by way of the countercylinder 19 onto the deflection rollers 2 and 3 to the vacuum cylinder 5 and is cut up there by means of the cutters 6*a* into pieces of foil tube 9 (see FIG. 6). The punching of the window opening areas 106 takes place on the countercylinder 19. The foil tube 1, which at the time of the punching lies flat and is in two layers, may not be punched through. The lower tube wall may at the most be slit slightly. The way in which this is achieved was described in connection with FIG. 12.

We claim:

1. In combination, a folding box and an inside lining, said box having a prepunched opening area for extraction of contents, which area may be ripped open, said inside lining being formed with an impressed window opening area, the box's prepunched opening area and the inside lining's window area being adhered to each other, said inside lining being formed by a foil tube piece which is closed in the longitudinal direction of the tube, a first connection between said box and said inside lining along which said box and inside lining are sealed to each other, said first connection at least partially framing the window opening area and a further connection between said box and said inside lining along which said box and inside lining are sealed to each other, said further connection being specularly symmetrical to the first connection in regard to a folding line which develops on the foil tube piece when it is laid flat for impressing the window opening area, said further connection completely framing the area which corresponds to the window opening area.

2. A combination according to claim 1 wherein said folding line which develops on the foil tube piece extends adjacent a folding line of said box which forms an edge of said box.

3. A combination according to claim 1 wherein the foil piece is plastic coated on the inside and wherein two parallel border areas of the foil piece are heat sealed to each other.

4. A combination according to claim 1 wherein two parallel border areas of the foil piece are heat sealed to each other.

5. A combination according to claim 4 wherein the folding line of the foil tube piece and the heat sealed border areas extend parallel to each other.

* * * * *